US012286321B2

(12) United States Patent
Kakuta

(10) Patent No.: US 12,286,321 B2
(45) Date of Patent: Apr. 29, 2025

(54) MANUAL BYPASS TRAY HAVING OPENING FOR ACCOMMODATING PROJECTION STICKING OUT FROM SIDE FACE OF IMAGE FORMING APPARATUS MAIN BODY, AND IMAGE FORMING APPARATUS

(71) Applicant: KYOCERA Document Solutions Inc., Osaka (JP)

(72) Inventor: Masayuki Kakuta, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 247 days.

(21) Appl. No.: 18/136,165

(22) Filed: Apr. 18, 2023

(65) Prior Publication Data

US 2023/0348221 A1 Nov. 2, 2023

(30) Foreign Application Priority Data

Apr. 28, 2022 (JP) ..... 2022-074693

(51) Int. Cl.
*B65H 31/00* (2006.01)

(52) U.S. Cl.
CPC ..... *B65H 31/00* (2013.01); *B65H 2402/443* (2013.01)

(58) Field of Classification Search
CPC ..... B65H 31/00; B65H 2402/443; B65H 2405/11164; B65H 2405/324; B65H 2405/354; B65H 2407/21; B65H 2801/06; B65H 1/266; G03G 15/6514
See application file for complete search history.

(56) References Cited

U.S. PATENT DOCUMENTS

| | | | | |
|---|---|---|---|---|
| 7,036,813 | B2 * | 5/2006 | Asada | B65H 3/0669 271/9.09 |
| 7,748,691 | B2 * | 7/2010 | Mizuguchi | G03G 15/6514 271/171 |
| 9,004,484 | B2 * | 4/2015 | Murakami | B65H 1/04 271/145 |
| 9,067,747 | B2 * | 6/2015 | Kawashima | B65H 5/00 |
| 9,725,260 | B2 * | 8/2017 | Furusawa | B65H 3/0607 |
| 10,053,310 | B2 * | 8/2018 | Nishiyama | B65H 1/04 |
| 10,351,366 | B2 * | 7/2019 | Oshida | G03G 15/6514 |

(Continued)

FOREIGN PATENT DOCUMENTS

| | | |
|---|---|---|
| JP | 2014162581 A | 9/2014 |
| JP | 2016005986 A | 1/2016 |

*Primary Examiner* — Leslie A Nicholson, III
(74) *Attorney, Agent, or Firm* — IP Business Solutions, LLC.

(57) ABSTRACT

A manual bypass tray includes a tray main body and an auxiliary tray. A placement surface of the tray main body is provided with an opening. The tray main body includes an opening cover. The auxiliary tray includes a recess. The opening cover is displaced to a retracted posture, thereby being accommodated inside the recess, together with a protruding portion protruding from a side face of a main body of an image forming apparatus, when the tray main body is in a storage position with the auxiliary tray accommodated therein, displaced to a closing posture, when the tray main body is in a sheet feeding position with the auxiliary tray accommodated therein, and displaced to a closing posture when the tray main body is in the sheet feeding position, with the auxiliary tray drawn out from the inside of the tray main body.

5 Claims, 14 Drawing Sheets

(56) References Cited

U.S. PATENT DOCUMENTS

| | | | | |
|---|---|---|---|---|
| 11,577,530 | B2 * | 2/2023 | Nguyen | G03G 15/6514 |
| 2014/0241775 | A1 | 8/2014 | Kawashima | |
| 2015/0344244 | A1 | 12/2015 | Koga et al. | |

* cited by examiner

MANUAL BYPASS TRAY HAVING OPENING FOR ACCOMMODATING PROJECTION STICKING OUT FROM SIDE FACE OF IMAGE FORMING APPARATUS MAIN BODY, AND IMAGE FORMING APPARATUS

INCORPORATION BY REFERENCE

This application claims priority to Japanese Patent Application No. 2022-074693 filed on Apr. 28, 2022, the entire contents of which are incorporated by reference herein.

BACKGROUND

The present disclosure relates to a manual bypass tray openably attached to a side face of the main body of an image forming apparatus, and an image forming apparatus including the manual bypass tray.

Image forming apparatuses such as a copier and a multifunction peripheral are widely known. For example, the image forming apparatuses that include a manual bypass tray are generally known. The manual bypass tray is openably attached to a side face of the main body of the image forming apparatus, and enables manual feeding of a sheet. In addition, an image forming apparatus is known that includes the main body of the manual bypass tray, and an auxiliary tray accommodated in the main body of the manual bypass tray, and configured to be drawn out in a direction opposite to a sheet feeding direction.

SUMMARY

The disclosure proposes further improvement of the foregoing techniques.

In an aspect, the disclosure provides a manual bypass tray openably and closably attached to a side face of a main body of an image forming apparatus, and configured to enable manual feeding of a sheet. The manual bypass tray includes a tray main body, and an auxiliary tray. The tray main body includes a placement surface for placing the sheet, and has a portion on a downstream side in a sheet feeding direction openably and closably supported by the side face. The tray main body is set, by being made to cover the side face, to a storage position in which the tray main body is accommodated in the apparatus main body along the side face, and set, by being made to open the side face, to a sheet feeding position in which the tray main body assumes an inclined posture, such that a portion on an upstream side in the sheet feeding direction is located on an upper side of the portion on the downstream side, to enable the sheet to be placed on the placement surface. The auxiliary tray includes an auxiliary placement surface for placing the sheet, and is configured to be accommodated inside the tray main body. The auxiliary tray is movable in a draw-out direction for being drawn out from the inside, and in a retracting direction for being retracted into the inside. The placement surface of the tray main body is provided with an opening that allows a protruding portion, protruding from the side face of the apparatus main body, to intrude into the inside of the tray main body. The tray main body includes an opening cover. The opening cover is supported so as to pivot about a pivotal shaft extending in a direction orthogonal to the sheet feeding direction, configured to assume, by pivoting, one of a closing posture for closing the opening, a retracted posture of being retracted from the opening into the inside of the tray main body, and a protruding posture of protruding from the opening, and formed in a shape that enables the protruding portion to be accommodated. The auxiliary tray includes a recess. The recess is located so as to oppose the opening when the auxiliary tray is accommodated inside the tray main body, and configured to accommodate the opening cover so as to allow displacement between the closing posture and the retracted posture. The opening cover is displaced to the retracted posture, thereby being accommodated inside the recess together with the protruding portion, by pivoting in the recess in contact with the protruding portion, when the tray main body is in the storage position with the auxiliary tray accommodated therein, displaced to the closing posture by pivoting inside the recess, when the tray main body is in the sheet feeding position with the auxiliary tray accommodated therein, and displaced to the closing posture by pivoting inside the tray main body, when the tray main body is in the sheet feeding position, with the auxiliary tray drawn out from the inside of the tray main body.

In another aspect, the disclosure provides an image forming apparatus including the foregoing manual bypass tray the apparatus main body, a sheet transport route, a transport roller, and an image forming device. The sheet transport route is formed along the side face of the apparatus main body, and includes the protruding portion. The transport roller is for transporting the sheet, and located on the sheet transport route, at a position that allows the transport roller to be accommodated inside the protruding portion from a side of the sheet transport route. The image forming device forms an image on the sheet transported by the transport roller.

DETAILED DESCRIPTION

Figure 1:
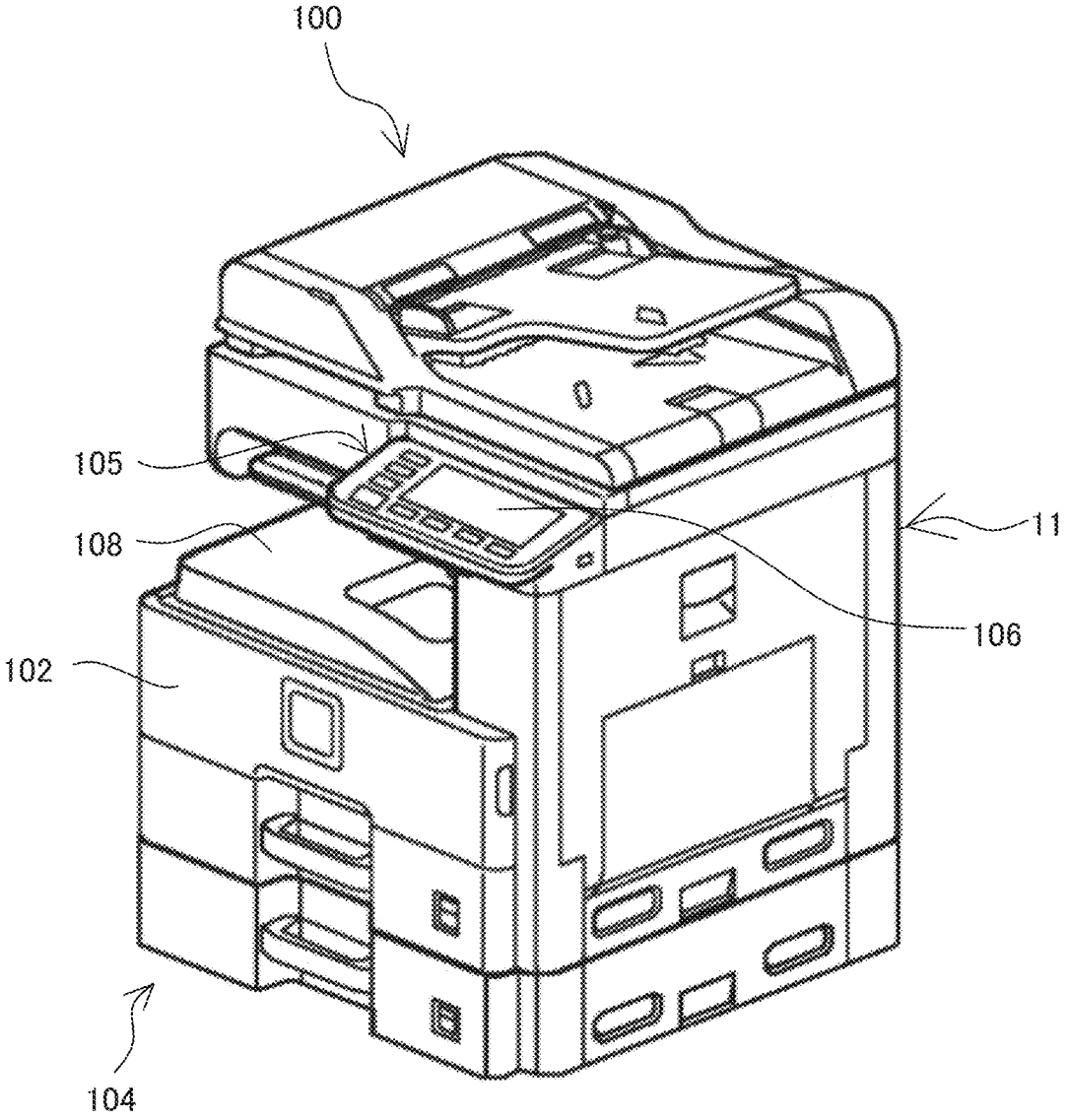
FIG. 1 is a perspective view showing the appearance of an image forming apparatus.
Figure 2:
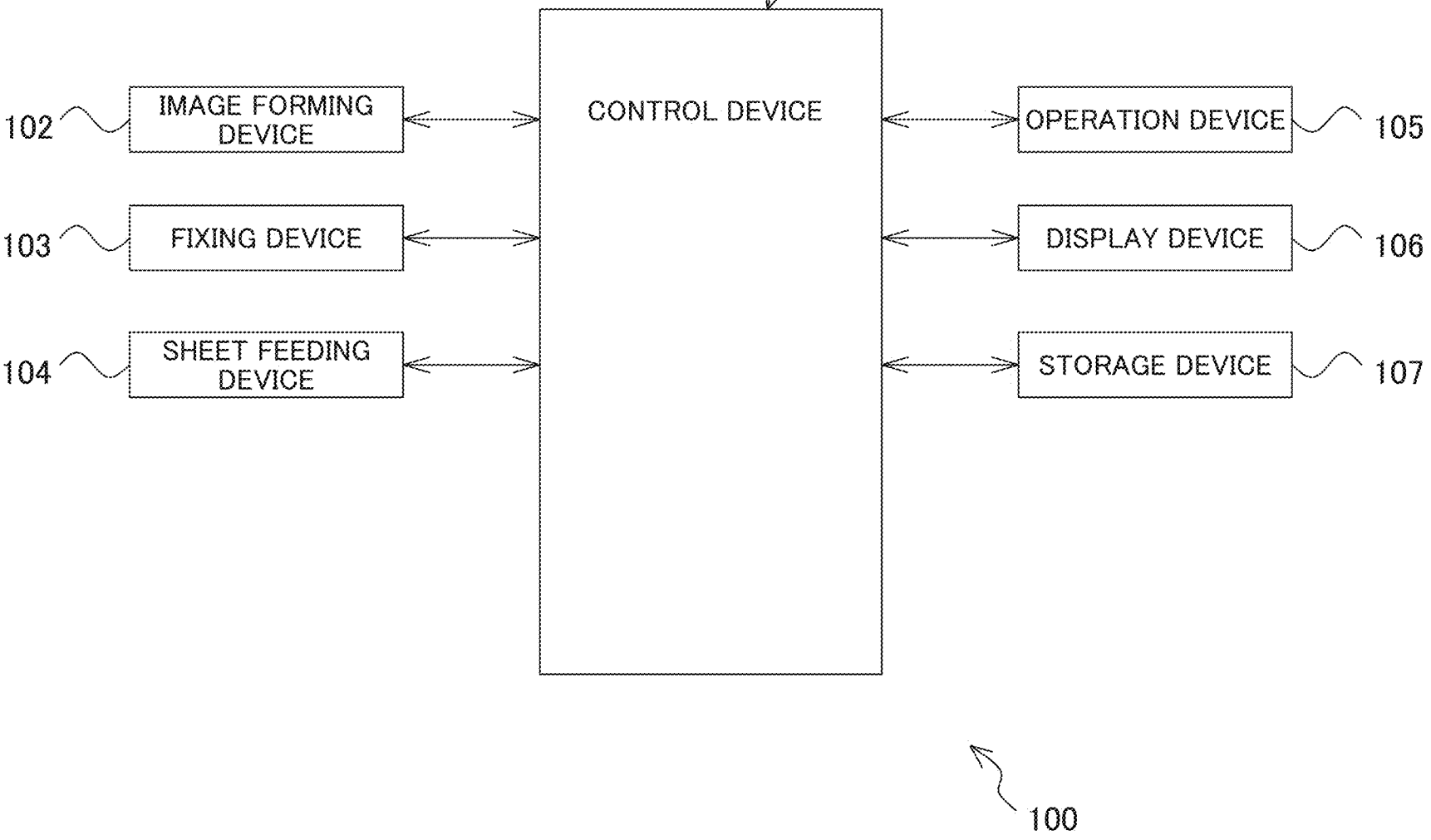
FIG. 2 is a functional block diagram schematically showing an essential internal configuration of the image forming apparatus.
Figure 3A:
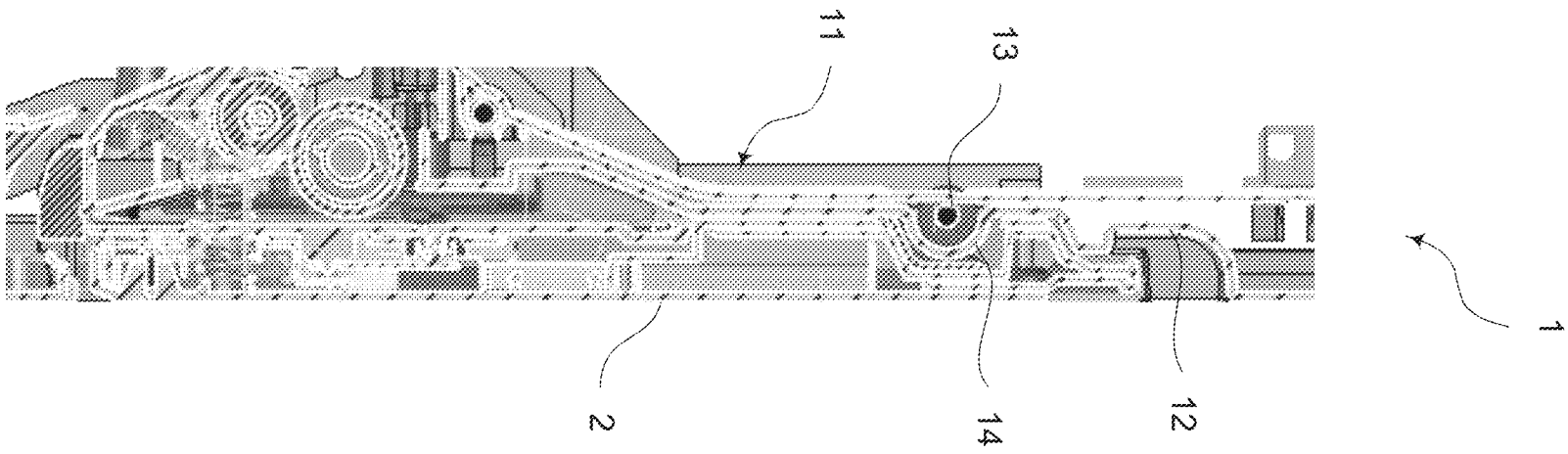
FIG. 3A and FIG. 3B are front cross-sectional views each showing a manual bypass tray.
Figure 3B:
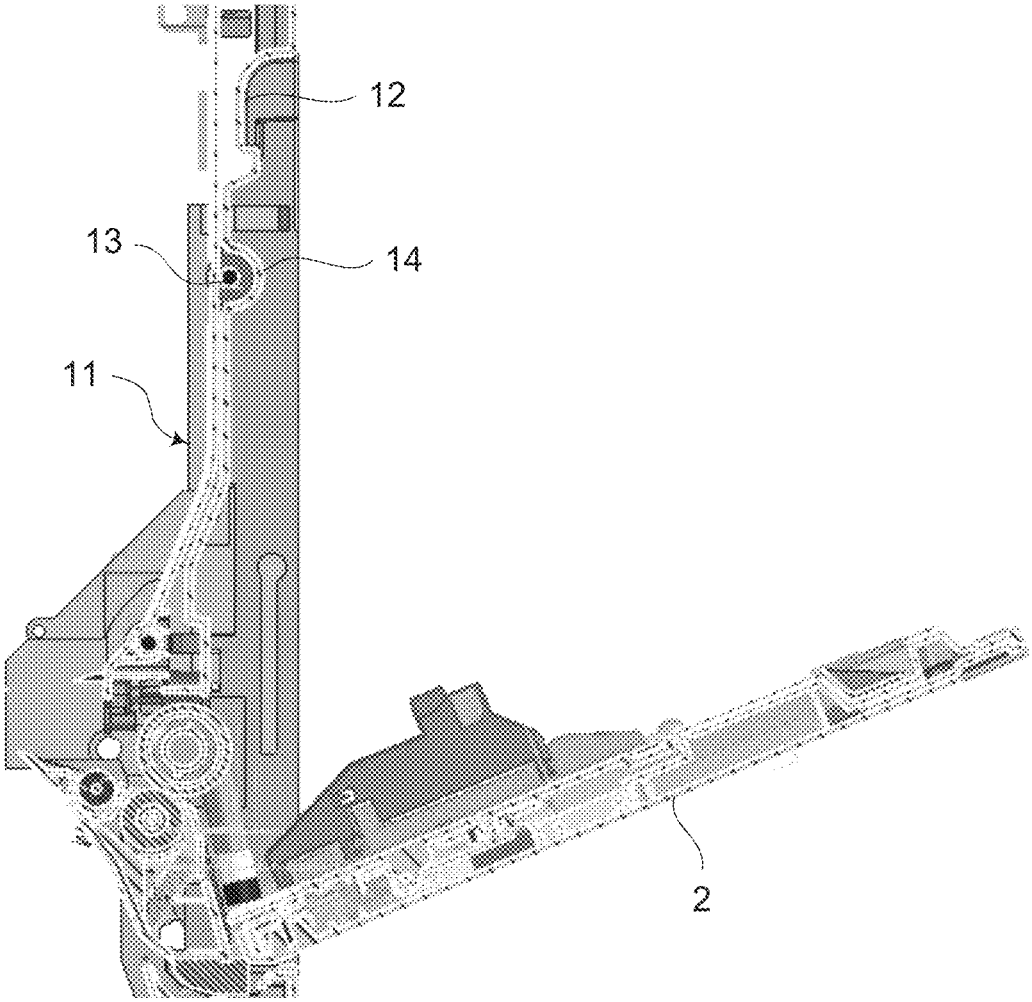
Figure 4A:
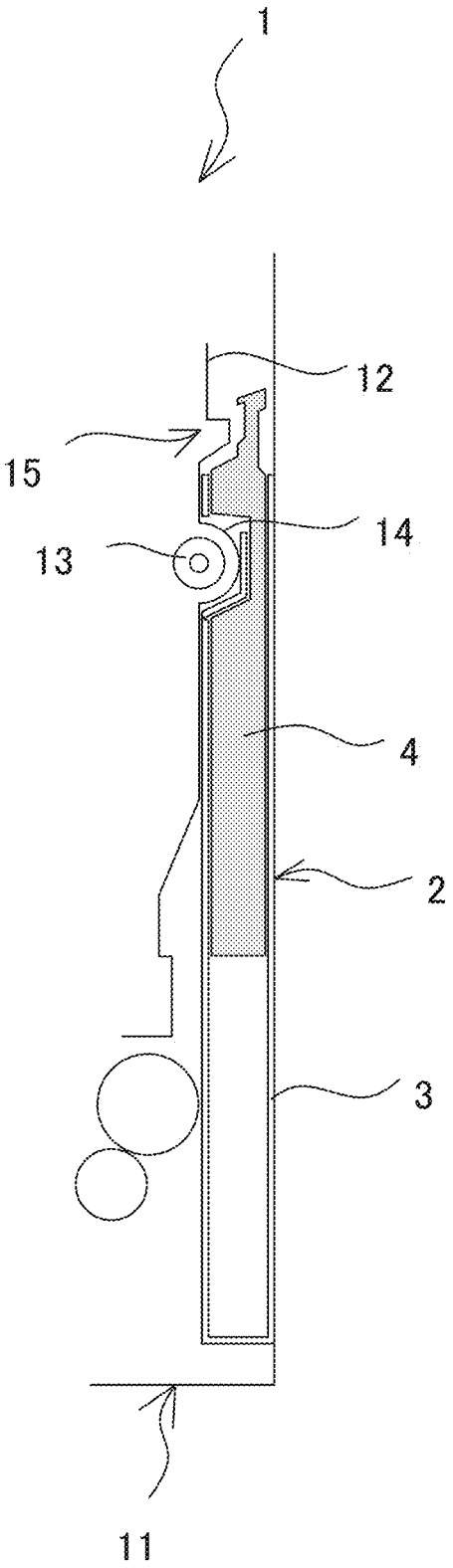
FIG. 4A and FIG. 4B are simplified front views of the manual bypass tray.
Figure 4B:
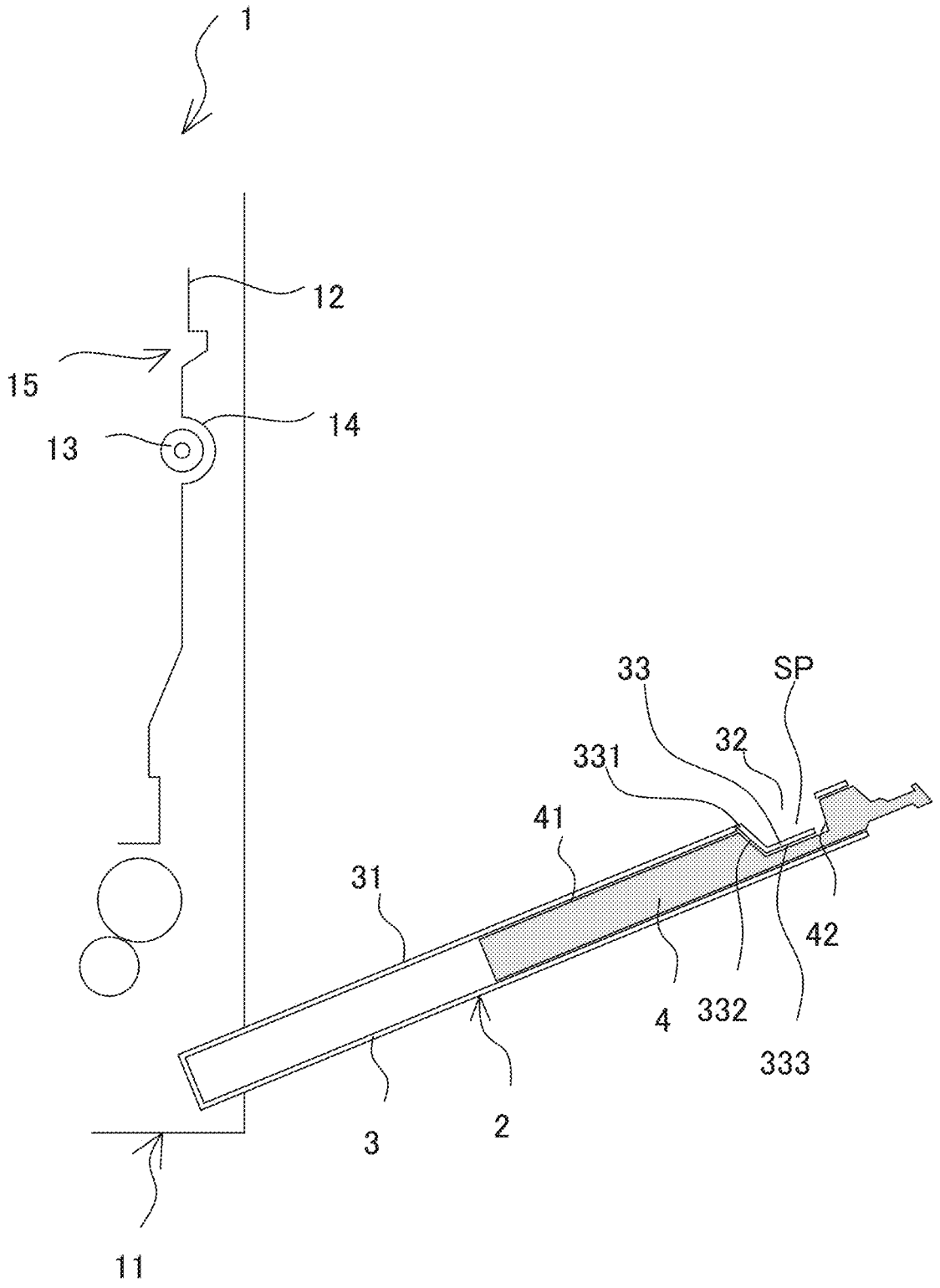

Hereafter, a manual bypass tray and an image forming apparatus including the manual bypass tray, according to an embodiment of the disclosure, will be described with reference to the drawings. FIG. 1 is a perspective view showing the appearance of the image forming apparatus 100 according to the embodiment of the disclosure. FIG. 2 is a functional block diagram schematically showing an essential internal configuration of the image forming apparatus 100. FIG. 3A and FIG. 3B are front cross-sectional views each showing the manual bypass tray 2 according to the embodiment of the disclosure. FIG. 4A and FIG. 4B are simplified front views of the manual bypass tray 2. FIG. 3A and FIG. 4A illustrate a state where the manual bypass tray 2 is closed. FIG. 3B and FIG. 4B illustrate a state where the manual bypass tray 2 is open. FIG. 3A and FIG. 3B, and FIG. 4A and FIG. 4B each illustrate a part of an apparatus main body 11.

The image forming apparatus 100 includes, inside the main body 11 thereof, a control device 101, an image forming device 102, a fixing device 103, a sheet feeding device 104, an operation device 105, a display device 106, and a storage device 107. The image forming device 102 forms a toner image on a sheet supplied from the sheet feeding device 104, for example on the basis of image data received from a computer connected via a network. The fixing device 103 heats and presses the sheet on which the toner image has been formed by the image forming device 102, to thereby fix the toner image on the sheet. The sheet that has undergone the fixing process is delivered to an output tray 108. The sheet feeding device 104 serves to supply the sheets to the image forming device 102. The sheet feeding device 104 includes a plurality of paper cassettes for storing the sheets, and a sheet feeding roller.

The operation device 105 includes a touch panel and physical keys. The operation device 105 receives user's instructions, according to the user's operation performed on the touch panel or the physical key. The display device 106 includes, for example, a liquid crystal display (LCD). The display device 106 displays, for example, an operation guide for the user. The storage device 107 is a large-capacity storage device such as a hard disk drive (HDD) and a solid state drive (SSD). The storage device 107 contains various control programs.

The control device 101 includes a processor, a random-access memory (RAM), a read-only memory (ROM), and an exclusive hardware circuit. The processor is, for example, a central processing unit (CPU), an application specific integrated circuit (ASIC), or a micro processing unit (MPU).

The control device 101 is connected to the image forming device 102, the fixing device 103, the sheet feeding device 104, the operation device 105, the display device 106, and the storage device 107, and controls the operation of the mentioned components, when the processor operates according to the control program stored in the storage device 107. For example, the control device 101 controls the operation of the image forming device 102, to form an image on the sheet supplied from the sheet feeding device 14.

The apparatus main body 11 includes a sheet transport route 15, a transport roller 13, a transport roller cover 14, and a pickup roller. The sheet transport route 15 is formed along a side face 12 of the apparatus main body 11, for transporting the sheet thereon. The transport roller 13 is provided on the sheet transport route 15. The transport roller cover 14 is provided on the sheet transport route 15 as a part thereof to cover the transport roller 13. The pickup roller picks up the sheets placed on the manual bypass tray 2 one by one, and delivers the sheet to the sheet transport route 15. The transport roller 13 is located at a position that allows the transport roller 13 to be accommodated inside the transport roller cover 14, from the side of the sheet transport route 15. The transport roller cover 14 is protruding from the side face 12 of the apparatus main body 11. The transport roller cover 14 exemplifies the protruding portion in the disclosure.

The manual bypass tray 2 is openably and closably attached to the side face 12 of the apparatus main body 11 of the image forming apparatus 1, and configured to enable manual feeding of the sheet. The manual bypass tray 2 includes a tray main body 3, and an auxiliary tray 4 (hatched portion in FIG. 4A and FIG. 4B). The auxiliary tray 4 is accommodated inside the tray main body 3, and configured to be drawn out in the direction opposite to a sheet feeding direction, and to be retracted in the sheet feeding direction.

The tray main body 3 includes a placement surface 31 for placing the sheet thereon. The portion of the tray main body 3 on the downstream side in the sheet feeding direction is openably and closably supported by the side face 12 of the apparatus main body 11. The tray main body 3 is configured to be switched between a storage position and a sheet feeding position. The storage position refers to a position in which the tray main body 3 is accommodated in the apparatus main body 11 along the side face 12. The sheet feeding position refers to a position in which tray main body 3 is opened from the side face 12 of the apparatus main body 11, and assuming an inclined posture such that the upstream side of the sheet feeding direction is located on the upper side of the downstream side, to enable the sheet to be placed on the placement surface 31, and fed into the apparatus main body 11. The tray main body 3 is set to the storage position by being made to close the side face 12, and to the sheet feeding position by being opened from the side face 12.

The tray main body 3 includes a storage compartment SP, an opening 32 to the storage compartment SP, and an opening cover 33. The storage compartment SP is for accommodating therein the transport roller cover 14 protruding from the side face 12, when the tray main body 3 is in the storage position. The opening 32 is formed in the placement surface 31. The opening cover 33 is supported so as to pivot about a pivotal shaft 331 extending in the direction orthogonal to the sheet feeding direction, and configured to cover the opening 32. Thus, the tray main body 3 includes the opening 32, which allows the transport roller cover 14 to intrude into inside of the tray main body 3. Therefore, the inside of the tray main body 3 serves as the storage compartment SP. In other words, the inside of the tray main body 3 possesses a sufficient space for accommodating the transport roller cover 14.

The auxiliary tray 4 is configured to be accommodated inside the tray main body 3. The auxiliary tray 4 includes an auxiliary placement surface 41 for placing the sheet thereon, and a recess 42. The recess 42 constitutes the storage compartment SP, when the auxiliary tray 4 is accommodated inside the tray main body 3. The auxiliary tray 4 is configured to move in a draw-out direction, to be drawn out from the inside of the tray main body 3 (i.e., direction opposite to the sheet feeding direction), and in a retracting direction to be retracted into the inside of the tray main body 3 (i.e., sheet feeding direction). The recess 42 is located so as to oppose the opening 32 inside the tray main body 3, when the auxiliary tray 4 is accommodated inside the tray main body 3. The recess 42 accommodates therein the opening cover 33, so as to allow the opening cover 33 to be displaced between a closing posture and a retracted posture, which will be subsequently described.

The opening cover 33 includes a first pressure-receiving surface 332 and a second pressure-receiving surface 333. The opening cover 33 is formed in a shape having a V-shaped cross section. The first pressure-receiving surface 332 has an end portion connected to the pivotal shaft 331, and is subjected to the pressure from the auxiliary tray 4 being drawn out (wall face of the recess 42 on the downstream side in the sheet feeding direction downstream). The second pressure-receiving surface 333 is continuous with the first pressure-receiving surface 332, and subjected to the pressure from the auxiliary tray 4 being retracted. The second pressure-receiving surface 333 is supported by the edge of the recess 42, when the auxiliary tray 4 is accommodated inside the tray main body 3. The opening cover 33 is made to pivot toward the outer side of the tray main body 3 about the pivotal shaft 331, when the first pressure-receiving surface 332 is subjected to the pressure from the auxiliary tray 4, to be lifted up to the upper position of the tray main body 3, and assumes a protruding posture protruding from the opening 32, thereby being retreated from the movement path of the auxiliary tray 4. When the auxiliary tray 4 is accommodated inside the tray main body 3, and therefore the opening cover 33 is not restricted from pivoting, the opening cover 33 pivots toward the inside of the tray main body 3 owing to the self-weight, and reaches the bottom face of the recess 42, as shown in FIG. 4B. In the case where the tray main body 3 is located at the storage position at this point, the opening cover 33 is accommodated in the recess 42, together with the transport roller cover 14.

In other words, the opening cover 33 is supported so as to pivot about a pivotal shaft extending in the direction orthogonal to the sheet feeding direction, and configured to assume, by pivoting, one of the closing posture for closing the opening 32, the retracted posture of being retracted from the opening 32 into the inside of the tray main body 3, and the protruding posture of protruding from the opening 32. The opening cover 33 is formed in a shape that enables the transport roller cover 14 to be accommodated therein. When the auxiliary tray 4 reaches a predetermined drawout position as result of the movement in the draw-out direction, the first pressure-receiving surface 332 is released from the pressure of the auxiliary tray 4, and therefore the opening cover 33 pivots toward the storage compartment SP in the tray main body 3 (inside of the tray main body 3). Further, the second pressure-receiving surface 333 is supported by a rear end portion 4R of the auxiliary tray 4 in the draw-out direction, and therefore the opening cover 33 assumes the closing posture of covering the opening 32.

Figure 5:
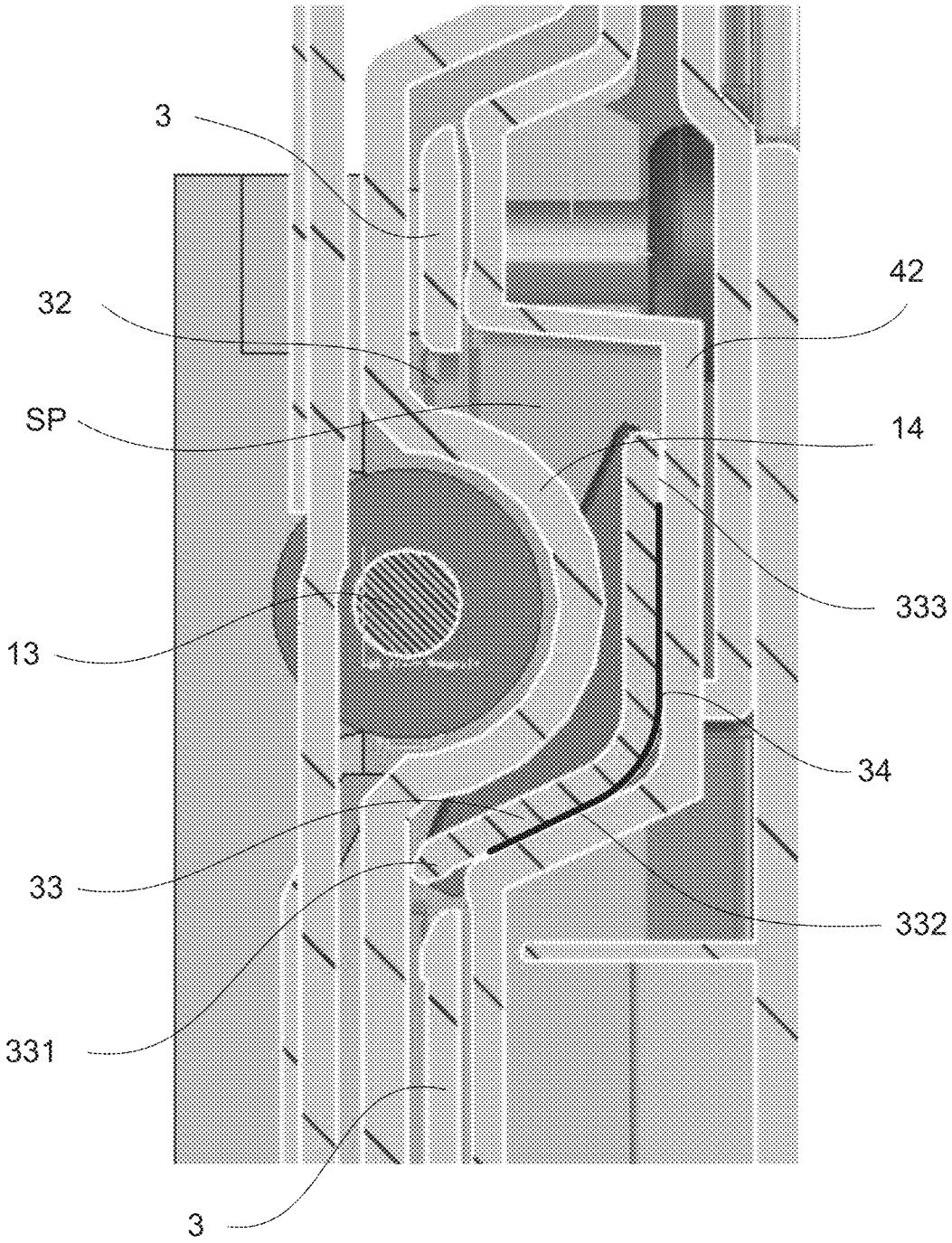
FIG. 5 is a front cross-sectional view showing a transport roller cover and related parts.

FIG. 5 is a front cross-sectional view showing the transport roller cover 14 and the related parts. The opening cover 33, having the V-shaped cross-section, is displaced to the retracted posture so as to open up the storage compartment SP, by pivoting about the pivotal shaft 331 inside the recess 42, toward the inside of the tray main body 3 in contact with the transport roller cover 14. In the storage compartment SP thus opened up, the transport roller cover 14 and the opening cover 33 are accommodated. The opening cover 33 includes an elastic sheet 34. The elastic sheet 34 includes an adhered portion provided on the side of an end portion and adhered to the lower face of the opening cover 33 (first pressure-receiving surface 332), and a cover portion provided on the side of the other end portion and extending in the radial direction of the pivotal shaft 331. Further detail of the elastic sheet 34 will be subsequently described.

Figure 6A:
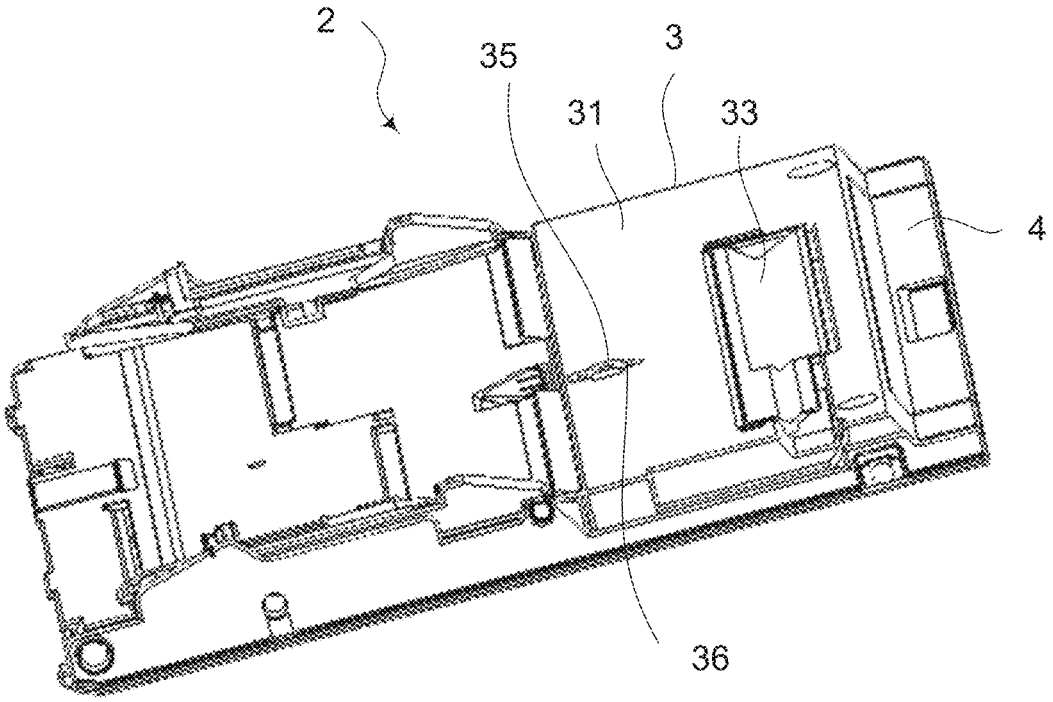
FIG. 6A and FIG. 6B are perspective views each showing the manual bypass tray.
Figure 6B:
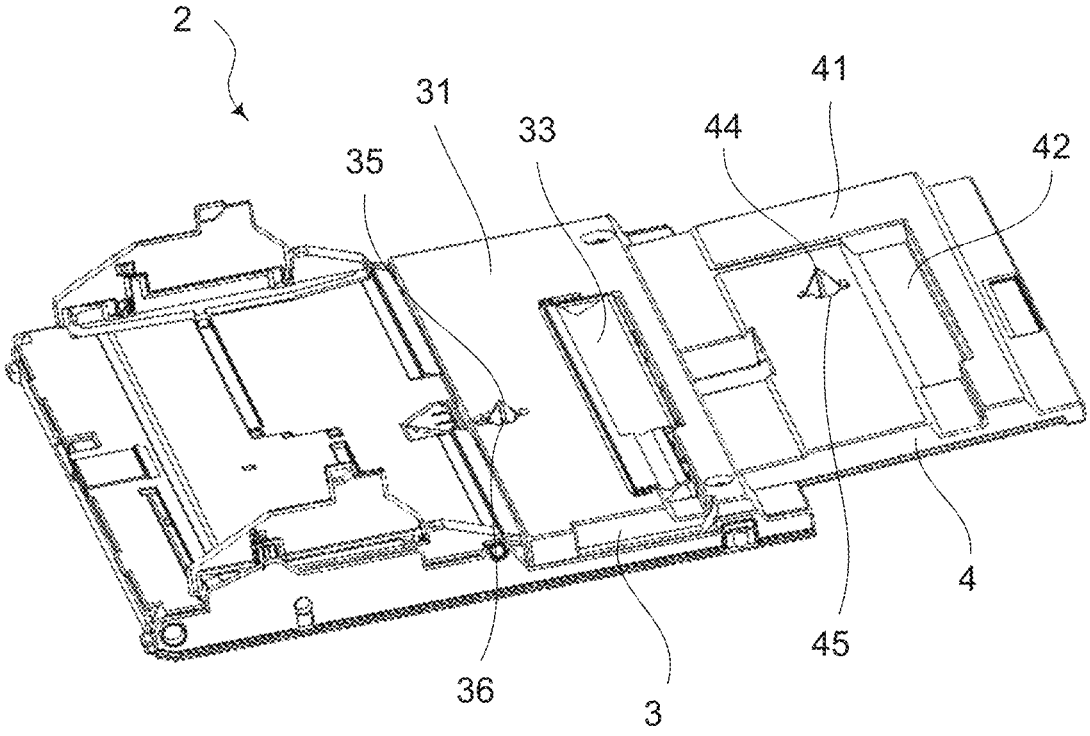

FIG. 6A and FIG. 6B are perspective views each showing the manual bypass tray 2. FIG. 6A illustrates the auxiliary tray 4 accommodated in the tray main body 3. FIG. 6B illustrates the auxiliary tray 4 drawn out from the tray main body 3.

The tray main body 3 includes a first size detection mechanism that detects the size of the sheet placed on the placement surface 31, in the longitudinal direction orthogonal to the width direction. The first size detection mechanism includes a known size detection actuator, configured to change the posture according to whether a sheet is placed on the placement surface 31. The size detection actuator includes a distal portion 35, configured to make contact with the lower face of the sheet placed on the placement surface 31. As shown in FIG. 6B, the placement surface 31 includes a slit 36, for the distal portion 35 of the size detection actuator to pass through.

The distal portion 35 is biased by a biasing member, so as to protrude upward from the slit 36. With a pressure from the upper side, the distal portion 35 is pressed downward to the lower side of the slit 36, and protruding upward from the slit 36, when the distal portion 35 is free from a pressure from the upper side. Accordingly, when a sheet is placed on the placement surface 31, the distal portion 35 is pressed downward because of the contact with the lower face of the sheet, so that the posture of the size detection actuator is changed.

The first size detection mechanism includes a sensor (e.g., transmissive optical sensor) for detecting the change of the posture of the size detection actuator. Such a sensor makes it possible to decide whether the size of the sheet placed on the placement surface 31, in the longitudinal direction (sheet feeding direction), is a size that reaches the location of the distal portion 35.

The auxiliary tray 4 includes, like the tray main body 3, a second size detection mechanism that detects the size of the sheet placed on the auxiliary placement surface 41 in the longitudinal direction. The second size detection mechanism includes a size detection actuator 43 (see FIG. 9), configured to change the posture according to whether a sheet is placed on the auxiliary placement surface 41. The size detection actuator 43 includes a distal portion 44, configured to make contact with the lower face of the sheet placed on the auxiliary placement surface 41. The second size detection mechanism exemplifies the size detection mechanism in the disclosure. The size detection actuator 43 exemplifies the size detection actuator in the disclosure.

The auxiliary placement surface 41 includes a slit 45, for the distal portion 44 of the size detection actuator 43 to pass through. The distal portion 44 is biased by a biasing member, so as to protrude upward from the slit 45 (to the outer side from the auxiliary placement surface 41). With a pressure from the upper (outer) side, the distal portion 44 is pressed downward to the lower side of the slit 45, and protruding upward from the slit 45, when the distal portion 44 is free from a pressure from the upper side. Accordingly, when a sheet is placed on the auxiliary placement surface 41, the distal portion 44 is pressed downward because of the contact with the lower face of the sheet, so that the posture of the size detection actuator 43 is changed.

The second size detection mechanism includes a sensor for detecting the change of the posture of the size detection actuator 43. Such a sensor makes it possible to decide whether the size of the sheet placed on the auxiliary placement surface 41, in the longitudinal direction, is a size that reaches the location of the distal portion 44.

Figure 7A:
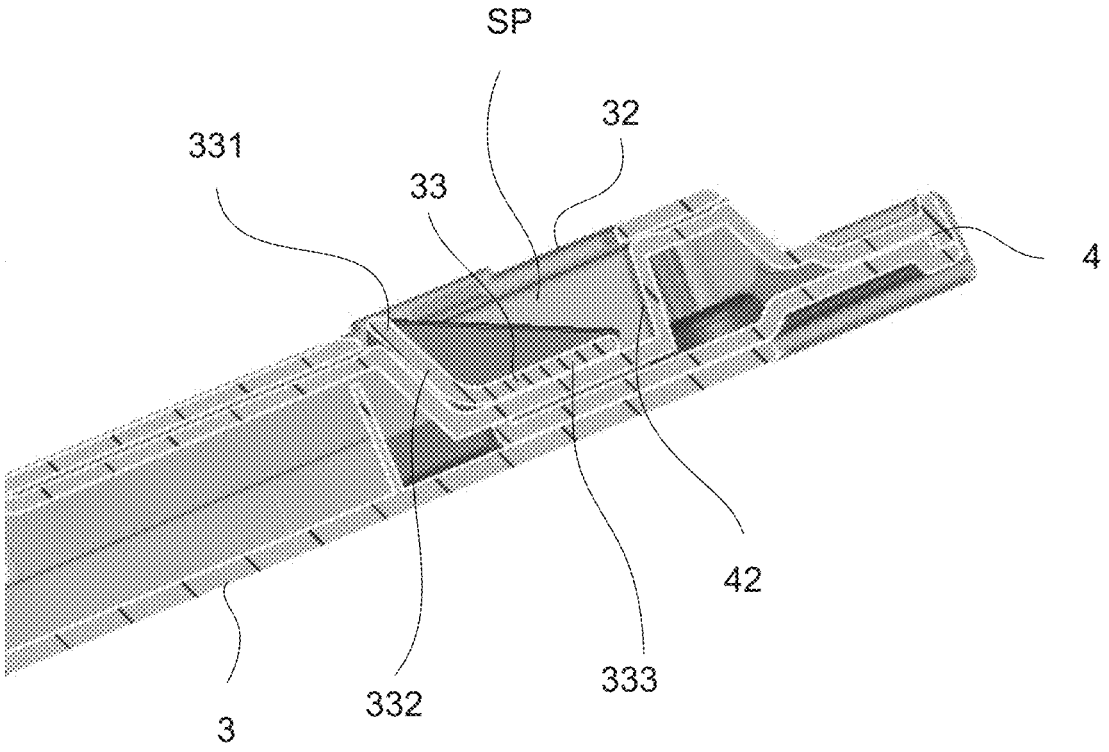
FIG. 7A to FIG. 7C are schematic drawings for explaining the status of an opening cover.
Figure 7B:
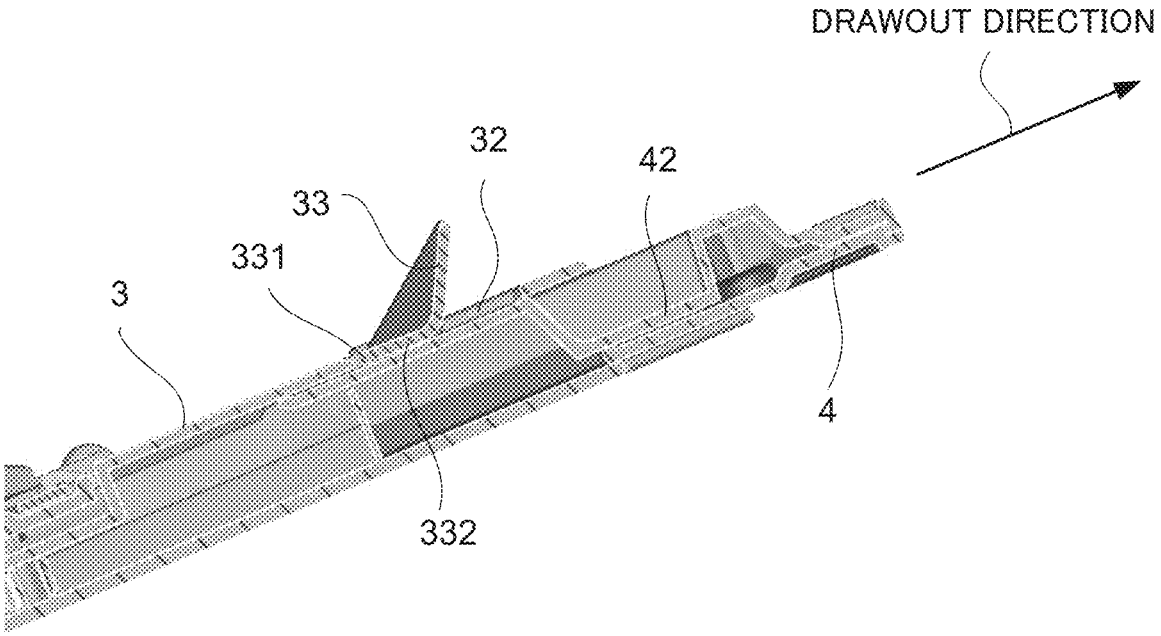
Figure 7C:
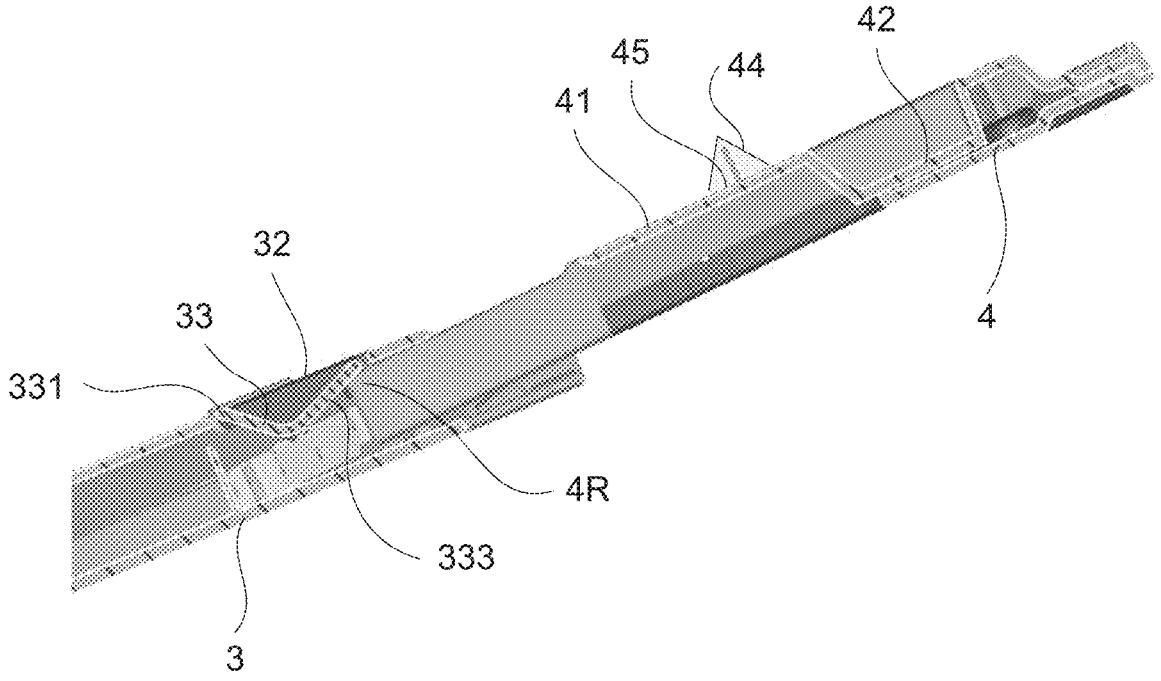

FIG. 7A to FIG. 7C are schematic drawings for explaining the status of an opening cover 33. As shown in FIG. 7A, when the auxiliary tray 4 is accommodated in the tray main body 3, the second pressure-receiving surface 333 of the opening cover 33 reaches the bottom face of the recess 42 of the auxiliary tray 4, and is located inside the tray main body 3. When the auxiliary tray 4 is drawn out from the tray main body 3, the first pressure-receiving surface 332 of the opening cover 33 is subjected to the pressure from the auxiliary tray 4 (wall face of the recess 42 on the downstream side in the sheet feeding direction). Therefore, the opening cover 33 is made to pivot about the pivotal shaft 331 to the outer side of the tray main body 3, thus to be lifted up to the upper side of the tray main body 3, and retreated from the movement path of the auxiliary tray 4, as shown in FIG. 7B.

The auxiliary tray 4 is fixed, upon being drawn out to a predetermined fixing position. FIG. 7C illustrates the auxiliary tray 4 drawn out to the fixing position. When the auxiliary tray 4 is drawn out to the fixing position and the opening 32 is opened up, the opening cover 33 pivots toward the inside of the tray main body 3, because of the self-weight.

Figure 8:
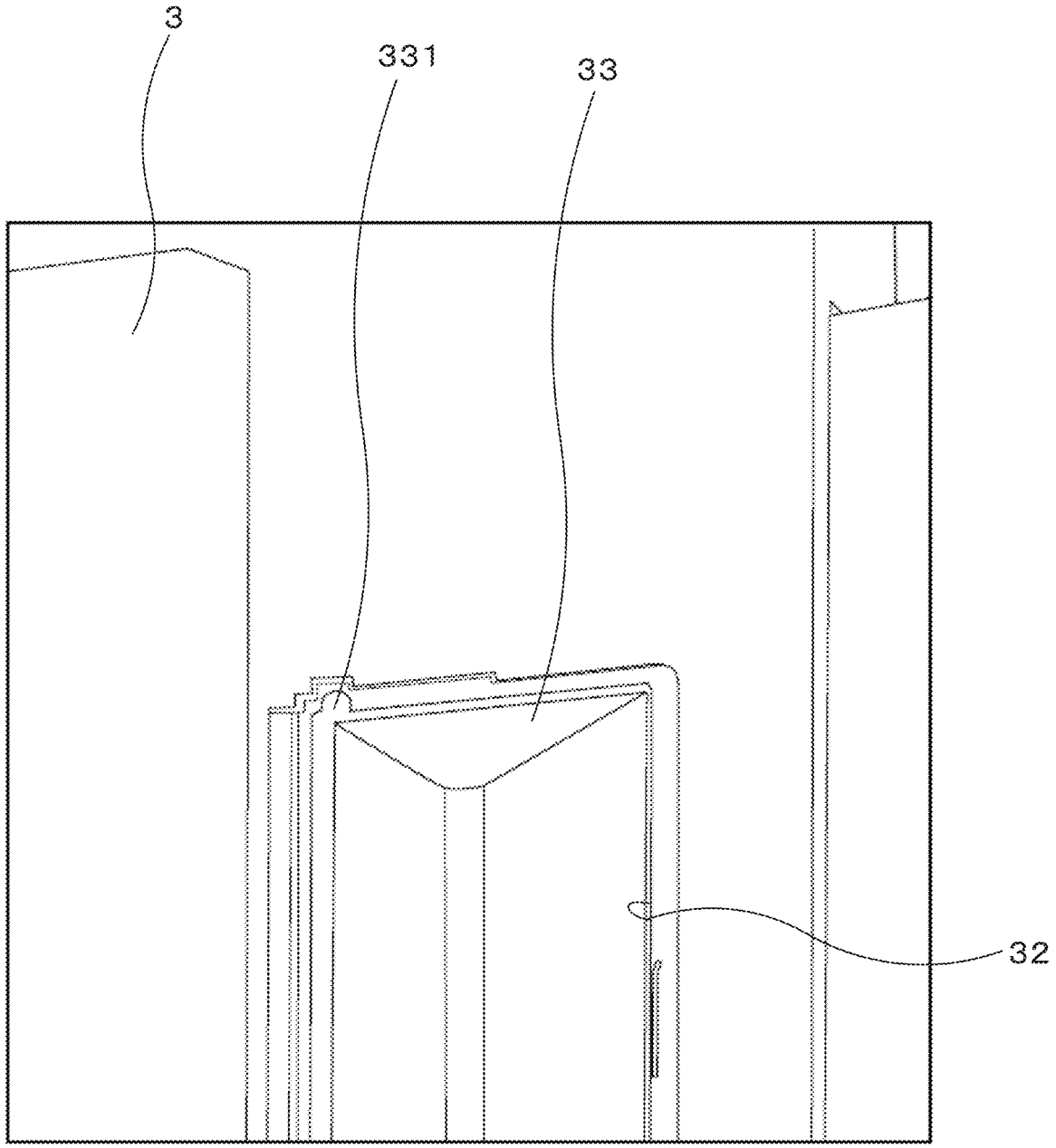
FIG. 8 is a perspective view showing the opening, covered with the opening cover.

The auxiliary tray 4 is formed such that the rear end portion 4R is exposed from the opening 32, when drawn out to the fixing position. Accordingly, the opening cover 33 is restricted from pivoting by the rear end portion 4R of the auxiliary tray 4, and unable to reach the bottom face of the recess 42. As result, the opening cover 33 stops at the position to close the opening 32 (displaced to the closing posture), as shown in FIG. 7C. FIG. 8 is a perspective view showing the opening 32, covered with the opening cover 33.

Here, the distal portion 44 of the size detection actuator 43 provided in the auxiliary tray 4 is pressed downward to the lower side of the slit 45, not only when the sheet is placed on the auxiliary placement surface 41, but also during the process that the auxiliary tray 4 is moved into the tray main body 3, because of the contact with the tray main body 3. When the auxiliary tray 4 is accommodated in the tray main body 3, the slit 45 is covered with the top plate of the tray main body 3, and therefore the distal portion 44 remains inside the tray main body 3, without protruding upward through the slit 45.

When the auxiliary tray 4 is drawn out from the tray main body 3 in the mentioned state, and the slit 45 reaches the opening 32 thus to be opened up, the distal portion 44 protrudes upward through the slit 45, to the outer side of the tray main body 3. In this case, the distal portion 44 may be caught by the peripheral edge of the opening 32, and disturb the movement of the auxiliary tray 4.

Figure 9:
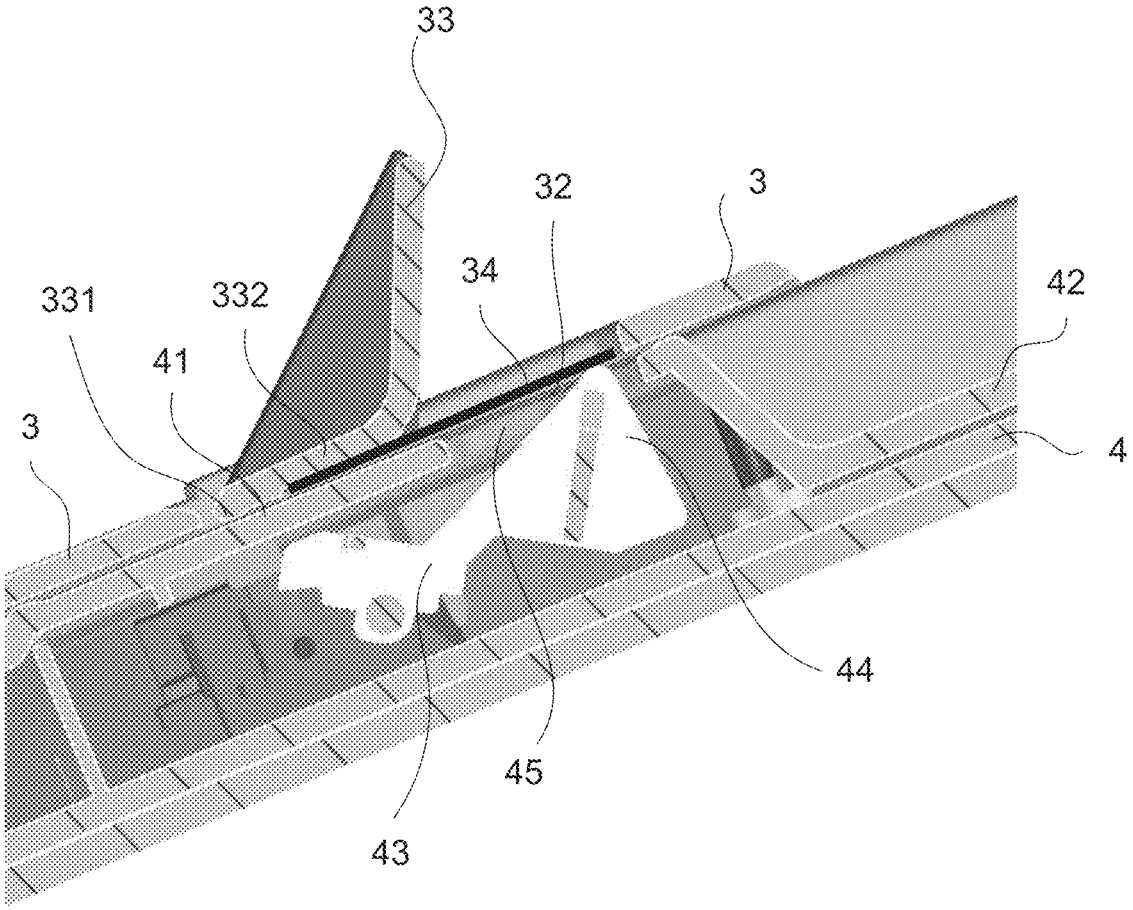
FIG. 9 is a front cross-sectional view showing an elastic sheet and the related parts.

To avoid the mentioned problem, the manual bypass tray 2 is provided with the elastic sheet 34 in this embodiment, as shown in FIG. 5. The elastic sheet 34 includes the adhered portion provided on the side of an end portion and adhered to the lower face of the opening cover 33 (first pressure-receiving surface 332), and the cover portion provided on the side of the other end portion and extending in the radial direction of the pivotal shaft 331, beyond the first pressure-receiving surface 332. Therefore, as shown in FIG. 9, when the opening cover 33 is lifted up to the upper side of the tray main body 3, the elastic sheet 34 is retained on a plane generally flush with the first pressure-receiving surface 332, so as to cover the opening 32.

In other words, when the auxiliary tray 4 is drawn out from the inside of the tray main body 3, and the opening cover 33 assumes the protruding posture of protruding from the opening 32, by being made to pivot to the outer side of the tray main body 3 thus to be lifted up, the elastic sheet 34 moves to the position where the cover portion covers the opening 32. On the other hand, when the auxiliary tray 4 is accommodated inside the tray main body 3, and the opening cover 33 is accommodated inside the recess 42, the cover portion is elastically deformed along the second pressure-receiving surface 333, thus to be located between the second pressure-receiving surface 333 and the bottom face of the recess 42.

Accordingly, the slit 45 is covered with the elastic sheet 34, despite reaching the opening 32. Therefore, the distal portion 44 is kept from protruding upward through the slit 45, because of the contact with the elastic sheet 34, and consequently the movement of the auxiliary tray 4 is exempted from being disturbed. Here, it suffices that the elastic sheet 34 is located on the movement path of the slit 45, which moves in accordance with the auxiliary tray 4.

Now, owing to the current demand for reduction in size of the image forming apparatus, a part of the structural components may inevitably protrude from the apparatus main body. For example, when the transport roller cover, covering the transport roller for transporting the sheet, is protruding from the side face of the apparatus main body, the manual bypass tray is unable to be accommodated inside, and it becomes difficult to reduce the size of the apparatus.

According to the foregoing embodiment, the transport roller cover 14, corresponding to the protruding portion, is accommodated in the storage compartment SP provided in the tray main body 3, and therefore the manual bypass tray 2 can be set to the closed position on the side face 12 of the apparatus main body 11, with the transport roller cover 14 accommodated in the storage compartment SP, despite the apparatus main body 11 having the protruding portion. Such a configuration enables further reduction in size of the image forming apparatus 1.

In addition, when the auxiliary tray 4 is drawn out to the fixing position, the opening cover 33 stops at the position for covering the opening 32 of the storage compartment SP, so that the opening 32 is covered with the opening cover 33, as shown in FIG. 7C. Therefore, the inside of the tray main body 3 is not exposed from the opening 32. Since the storage compartment SP is constituted of the recess 42 of the auxiliary tray 4, it is the wall faces of the recess 42 (wall face on the upstream side in the sheet feeding direction, and wall face in the width direction) and the opening cover 33, and not the inside of the tray main body 3, that are exposed from the opening 32, as shown in FIG. 7A, when the auxiliary tray 4 is accommodated inside the tray main body 3.

Thus, although the opening 32 is not covered with the opening cover 33, the inside of the tray main body 3 is not exposed from the opening 32, when the auxiliary tray 4 is accommodated inside the tray main body 3. Since the inside of the tray main body 3 is not exposed from the opening 32 as described above, an accidental contact between the electric parts in the tray main body 3 and a user's hand, and deposition of dust inside the tray main body 3, can be prevented.

The opening cover 33 located inside the tray main body 3 disturbs the movement (in the draw-out direction and retracting direction) of the auxiliary tray 4. However, the opening cover 33 according to the foregoing embodiment is made to pivot to the outer side of the tray main body 3, thus to be lifted up to the upper side of the tray main body 3, upon being pressed by the auxiliary tray 4, and retreated from the movement path of the auxiliary tray 4. Therefore, the movement of the auxiliary tray 4 is not disturbed.

According to the foregoing embodiment, as shown in FIG. 3B and FIG. 7A, the opening cover 33 reaches the recess 42 of the auxiliary tray 4, owing to the self-weight, when the auxiliary tray 4 is accommodated in the tray main body 3. However, the disclosure is not limited to such embodiment. For example, as another embodiment, a biasing member that biases the opening cover 33, such that a reference position thereof is located so as to cover the opening 32, may be provided, so that the opening cover 33 can maintain the posture of covering the opening 32, because of being biased as above, even when the auxiliary tray 4 is accommodated in the tray main body 3.

The disclosure may be modified in various manners, without limitation to the foregoing embodiment. Further, the configurations of the foregoing embodiment, described with reference to FIG. 1 to FIG. 9, are merely exemplary, and in no way intended to limit the disclosure to those configurations.

While the present disclosure has been described in detail with reference to the embodiments thereof, it would be apparent to those skilled in the art the various changes and modifications may be made therein within the scope defined by the appended claims.

What is claimed is:

1. A manual bypass tray openably and closably attached to a side face of a main body of an image forming apparatus, and configured to enable manual feeding of a sheet, the manual bypass tray comprising:

a tray main body including a placement surface for placing the sheet, and having a portion on a downstream side in a sheet feeding direction openably and closably supported by the side face, the tray main body being set, by being made to cover the side face, to a storage position in which the tray main body is accommodated in the apparatus main body along the side face, and set, by being made to open the side face, to a sheet feeding position in which the tray main body assumes an inclined posture, such that a portion on an upstream side in the sheet feeding direction is located on an upper side of the portion on the downstream side, to enable the sheet to be placed on the placement surface; and an auxiliary tray including an auxiliary placement surface for placing the sheet, and configured to be accommodated inside the tray main body, the auxiliary tray being movable in a draw-out direction for being drawn-out from the inside, and in a retracting direction for being retracted into the inside, wherein the placement surface of the tray main body is provided with an opening that allows a protruding portion, protruding from the side face of the apparatus main body, to intrude into the inside of the tray main body, the tray main body includes an opening cover supported so as to pivot about a pivotal shaft extending in a direction orthogonal to the sheet feeding direction, configured to assume, by pivoting, one of a closing posture for closing the opening, a retracted posture of being retracted from the opening into the inside of the tray main body, and a protruding posture of protruding from the opening, and formed in a shape that enables the protruding portion to be accommodated, the auxiliary tray includes a recess located so as to oppose the opening, when the auxiliary tray is accommodated inside the tray main body, and configured to accommodate the opening cover so as to allow displacement between the closing posture and the retracted posture, the opening cover is:

displaced to the retracted posture, thereby being accommodated inside the recess together with the protruding portion, by pivoting in the recess in contact with the protruding portion, when the tray main body is in the storage position with the auxiliary tray accommodated therein;

displaced to the closing posture by pivoting in the recess, when the tray main body is in the sheet feeding position with the auxiliary tray, accommodated therein; and displaced to the closing posture by pivoting inside the tray main body, when the tray main body is in the sheet feeding position, with the auxiliary tray drawn out from the inside of the tray main body.

2. The manual bypass tray according to claim 1, wherein the opening cover includes a first pressure-receiving surface to be subjected to a pressure from the auxiliary tray, when the auxiliary tray moves to the draw-out direction, and a second pressure-receiving surface to be supported by an edge of the recess, when the auxiliary tray is accommodated inside the tray main body, the opening cover assumes the protruding posture, by being made to pivot, when the first pressure-receiving surface is pressed by the auxiliary tray, to an outer side of the placement surface thus to be lifted upward, thereby retreating from a movement path of the auxiliary tray, and the opening cover assumes the closing posture, by being made to pivot toward the inside of the tray main body, because of the first pressure-receiving surface being released from the pressure, when the auxiliary tray is moved in the draw-out direction to a predetermined draw-out position, so that the second pressure-receiving surface is supported by a rear end portion of the auxiliary tray in the draw-out direction.

3. The manual bypass tray according to claim 1, further comprising:

a size detection mechanism including a size detection actuator having a distal portion that makes contact with a lower face of the sheet placed on the auxiliary placement surface, and configured to change a posture according to whether the sheet is present, and a sensor that detects the posture of the size detection actuator; and an elastic sheet having one end portion adhered to a lower face of the opening cover, and the other end portion extending in a radial direction of the pivotal shaft, wherein the auxiliary placement surface includes a slit for the distal portion to pass through, the distal portion is pressed downward to a lower side of the slit, by a pressure from an upper side, and protrudes upward from the slit when the distal portion is free from the pressure from the upper side, the elastic sheet moves to a position for covering the opening, when the opening cover assumes the protruding posture, and the elastic sheet is located on a lower face of the opening cover, at a position at least corresponding to a movement path of the slit moving in accordance with the auxiliary tray.

4. The manual bypass tray according to claim 3, wherein the opening cover has a V-shaped cross section, and includes a first pressure-receiving surface having an end portion connected the pivotal shaft, and a second pressure-receiving surface continuous with the first pressure-receiving surface, the elastic sheet includes an adhered portion provided on a side of the one end portion, and adhered to the first pressure-receiving surface, and a cover portion provided on a side of the other end portion, and extending beyond the first pressure-receiving surface, and the elastic sheet is located at a position where the cover portion covers the opening, when the opening cover is lifted upward and protruding from the opening, and located between the second pressure-receiving surface and a bottom face of the recess, because of elastic deformation of the cover portion along the second pressure-receiving surface, when the opening cover is accommodated in the recess, with the auxiliary tray accommodated inside the tray main body.

5. An image forming apparatus comprising:

the manual bypass tray according to claim 1;

the apparatus main body;

a sheet transport route formed along the side face of the apparatus main body, and including the protruding portion;

a transport roller for transporting the sheet, and located on the sheet transport route, at a position that allows the transport roller to be accommodated inside the protruding portion from a side of the sheet transport route; and an image firming device that forms an image on the sheet transported by the transport roller.

* * * * *